US005483326A

United States Patent [19]

Kosmider

[11] Patent Number: 5,483,326

[45] Date of Patent: Jan. 9, 1996

[54] DEVELOPER CARRYING ROLLER HAVING A SURFACE LAYER WITH CONTOURED FINISH

[75] Inventor: Ronald T. Kosmider, Fairport, N.Y.

[73] Assignee: R. T. Kosminder, Inc., Fairport, N.Y.

[21] Appl. No.: 214,683

[22] Filed: Mar. 16, 1994

[51] Int. Cl.[6] ..... G03G 15/06

[52] U.S. Cl. ..... 355/245; 355/200; 355/251; 355/253

[58] Field of Search ..... 355/200, 245, 355/251, 252, 253, 271, 273, 277, 259; 118/651, 653, 656, 657, 658, 661; 430/31, 32, 48

[56] References Cited

U.S. PATENT DOCUMENTS

| | | | |
|---|---|---|---|
| 4,786,936 | 11/1988 | Ikegawa et al. | 355/253 |
| 4,982,689 | 1/1991 | Honda et al. | 118/656 |
| 4,989,044 | 1/1991 | Nishimura et al. . | |
| 5,009,974 | 4/1991 | Honda et al. | 430/69 |
| 5,027,745 | 7/1991 | Yamazaki et al. . | |
| 5,166,023 | 11/1992 | Harada et al. | 430/62 |
| 5,227,849 | 7/1993 | Katsumi et al. . | |
| 5,286,917 | 2/1994 | Unno et al. | 118/651 |
| 5,332,643 | 7/1994 | Harada et al. | 430/127 |
| 5,347,347 | 9/1994 | Hilbert et al. | 355/253 |

OTHER PUBLICATIONS

Richard Rhorer & Philip Hannah, Class Notes, Basic Diamond Turning Techniques, A Tutorial Presented at The American Socieity Engineering, Oct. 1991.

Jeffery W. Carr and C. Narayan, Single Point Diamond Machining Induced Damage on Single Copper, Aluminum and Gold, IBM Research Division, p. 96.

Lester Cornelius, How to Get Optimum Performance From SX, IIIsi, IIp, and Series 4 Mag Rollers, Optical Technologies Corp., Aug. 1992.

Robert S. Polvani and Chris J. Evans, Aluminum Optics, But of Which Alloy and What Temper' National Institute of Standards and Technology.

*Primary Examiner*—Sandra L. Brase

*Attorney, Agent, or Firm*—Cumpston & Shaw

[57] ABSTRACT

A sleeve for a magnetic roller to transfer a developer from a supply to a developing zone. The sleeve having a surface layer formed by burnishing the sleeve with a diamond, wherein the surface layer has an increased resistance to oxidation. A surface contour is formed on the sleeve to lie entirely within the surface layer, wherein the surface contour has a sufficient size to triboelectrically charge the developer. A method for forming the surface finish includes cutting the sleeve with a diamond and impacting a slurry against the sleeve to form the surface contours.

31 Claims, 2 Drawing Sheets

DEVELOPER CARRYING ROLLER HAVING A SURFACE LAYER WITH CONTOURED FINISH

FIELD OF THE INVENTION

The present invention relates to a developing apparatus for developing an electrostatic latent image, and more particularly, to a nonferrous magnetic roller sleeve with a burnished surface layer of sealed intermetallic grain boundaries having a reduced oxidation rate, wherein the surface layer is impressed with a multiplicity of indentations which extend into the surface layer without rupturing the sealed grain boundaries or penetrating the surface layer.

BACKGROUND OF THE INVENTION

The photocopying and laser printing industry is tending towards a dry type, monocomponent developer which does not contain carrier particles. In a developing apparatus using the monocomponent developer, the toner particles are triboelectrically charged by friction with a developer carrying member to a polarity suitable for developing the latent image. In that area of the developer carrying member which is opposed to a non image area (background) of the image beating member, the developer is not consumed. If the state of this no consumption of the developer continues, a layer of fine developer particles is strongly deposited thereon, presumably due to the electrostatic image force, and the particles are not easily consumed for development of the image area of the image beating member once the strong deposition is established. In addition, the existence of such a strongly deposited layer decreases the amount of charge of the developer present on the strongly deposited fine particle layer. This results in production of a ghost image on the developer image thus deteriorating the image quality.

Further, it is believed that particle size distribution in the bottom most toner layer on the developing sleeve is different in the toner consumed portion than the not consumed portion. More particularly, the fine particle layer is formed at the bottom of the non consumed portion. Since a fine particle has a larger surface area per unit volume, the amount of triboelectric charge per unit weight is greater than a larger size particle. Therefore, the fine particles are more strongly attracted to the developer carrying member by the electrostatic force due to the image force. Thus, the toner particles outside the portion where the fine particle layer is formed are not sufficiently triboelectrically charged by friction with the developing sleeve, and therefore, their developing power decreases, and they appear as a ghost on the image.

Also, when the developing sleeve is made of aluminum based materials, oxidation may form. The oxidation acts as an insulator and adversely effects the necessary charge for developing the latent image.

A number of techniques have been developed to enhance the image quality. Specifically, there are a number of patents which have roughened the surface of roller by blasting the surface with regular and/or irregular particles. A developing apparatus provided with a sleeve having a roughened surface is disclosed in U.S. Pat. Nos. 4,377,332, 4,300,966, and 4,807,461 corresponding to a Japanese laid-open Patent Application No. 131586/1989. In Japanese laid-open Patent Applications No. 116372/1982 and 11974/1983, a sleeve having a developer carrying surface blasted with a regular particles and/or regular particles is disclosed.

While stainless steel sleeves offer improved resistance to oxidation, the material cost as well as the processing costs reduces the economic appeal of such sleeves. In addition, aluminum based sleeves, while cheaper in material costs require coatings to provide sufficient oxidation resistance. Therefore, the need exists for magnetic roller sleeve formed of a cost effective material. The need also exists for the roller to have sufficient oxidation resistance without requiring additional coatings or processing.

SUMMARY OF THE INVENTION

The present invention provides a developer carrying member for transferring developer from a supply of developer to a developing zone where a latent image bearing member passes. The developer carrying member may be in the form of a sleeve formed of a nonferrous material and finished to create a surface layer, wherein the surface layer is burnished or amorphous to produce an oxidation rate which is less than the sleeve.

Specifically, one embodiment of the invention includes burnishing the surface of the sleeve to cold flow the outer layer of the sleeve material to substantially seal the grain boundaries and thereby inhibit oxidation. The amorphous or burnished surface layer is then impacted with a flowable medium to impart a surface texture, wherein the surface texture does not rupture the surface layer. The sleeve therefore retains the enhanced resistance to oxidation, while providing the necessary surface texture to transfer the developer.

The present invention also includes a method of manufacturing the developer carrying member by cutting the outer layer of the sleeve with a diamond to form the oxidation resistant surface layer and impacting a slurry against the cut surface to texture the surface, without rupturing the oxidation resistant surface layer. In the preferred embodiment, the surface layer and sleeve are formed of a contiguous and integral piece of material. That is, the surface layer is merely a processed portion of the material which comprises the sleeve.

DETAILED DESCRIPTION OF THE PREFERRED EMBODIMENT

Figure 1:
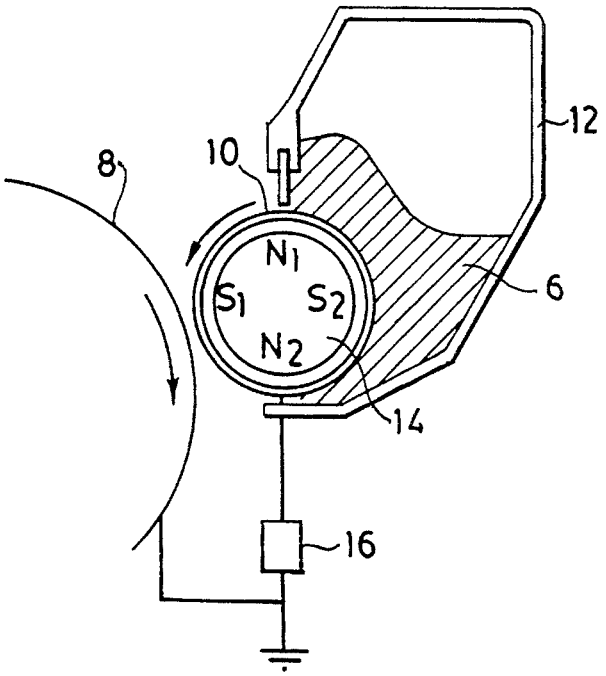
FIG. 1 is a schematic of the operating environment of the developer carrying member.
Figure 2:
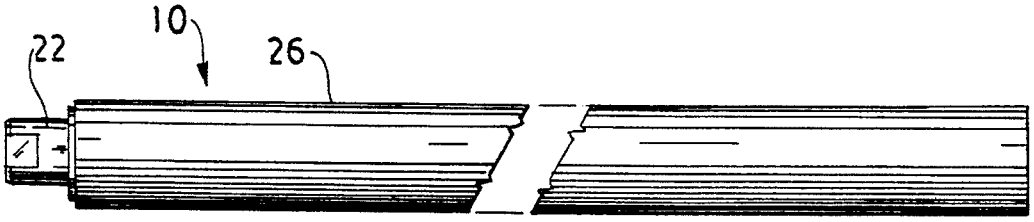
FIG. 2 is a side elevational view of the developer carrying member having a surface layer.

Referring to FIG. 1, the developer carrying member 10 of the present invention is employed in an image forming apparatus having a latent image bearing member which is usually in the form of a electrophotographic photosensitive member (hereinafter referred to as a "photosensitive drum") 8. Although the developer carrying member 10 is described in terms of a sleeve, it is understood that the developer carrying member may have a variety of configurations. The image forming apparatus further comprises a latent image forming station, a developing apparatus for visualizing the latent image, an image transfer and transfer material separating station which are well known in the art for transferring a toner image from a photosensitive drum to the transfer material and for separating the transfer material from the photosensitive drum 8, a cleaning station as known in the art for removing residual toner from the drum.

A developer 6 in this embodiment is a magnetic toner containing magnetic particles in a resin carrier. The developer 6 is a monocomponent dry developer (toner) which is free of the carrier particles contained in a two component developer. However, thermocomponent developer 6 is not limited to the developer consisting only of toner particles, but encompasses a developer containing, in addition to the toner particles, one or more additional powders or agents for enhancing fluidability of the developer, controlling charge amount of the toner and cleaning the surface of an image beating member.

The latent image forming station functions to form electrostatic latent image on photosensitive drum 8. The photosensitive drum 8 rotates in the direction indicated by the arrow in FIG. 1 to reach the developing device. The developing device includes a hopper 12 containing the magnetic toner 6 (one component developer) to form a supply of the toner. A stirring mechanism may be employed for supplying the toner 6 from the hopper 12 to the neighborhood of the sleeve 10 and for enhancing the flowability of the toner. The sleeve 10 is located to carry the toner particles 6 from the supply into the developing zone, where the sleeve is opposed to the photosensitive drum 8 so that the toner is supplied to the drum. The toner particles 6 are triboelectrically charged mainly by friction with the sleeve 10 to such an extent as is sufficient to develop the latent image.

A developing magnetic pole 14 is located within the sleeve 10 to generate brushes of toner particles 6 on the sleeve. In order to make the toner transfer easier, the sleeve 10 is supplied with a developing bias voltage from a voltage source 16. More particularly, an alternating bias voltage is applied to the sleeve 10 by the voltage source 16. In the developing zone where the sleeve 10 and the photosensitive drum 8 are opposed, and the toner particles 6 are formed into a brush by the developing magnetic pole 14, and an electric field is formed between a latent image and the photosensitive drum 8 and the sleeve. The toner particles 6 on the sleeve 10 are transferred to drum 8 to visualize the latent image thereon. The toner particles 6 are released from the sleeve 10 to the drum 8, repeat deposition on the drum and release therefrom and finally, when the drum surface moves away from the developing zone, the toner particles corresponding to the potential latent image are retained on the drum.

The toner image is then transferred from the photosensitive drum 8 to the transfer material at a transfer station and is fixed on the transfer material by an unshown image fixing station. After the image transfer, the photosensitive drum 8 is subjected to a cleaning operation of the cleaning station so that the residual toner is removed from the drum and the drum is prepared for the next image forming operation.

Referring to FIGS. 1–4, the sleeve 10 is a substantially cylindrical member sized to retain the developing magnetic pole 14 therein. The sleeve 10 is formed of photoreceptor grade aluminum and has an operating diameter of approximately ⅝ inch and an overall length of 10 1/16 inches. The sleeve 10 includes a friction fit transmission hub 22 affixedly attached at one by means well known in the art.

Figure 3:
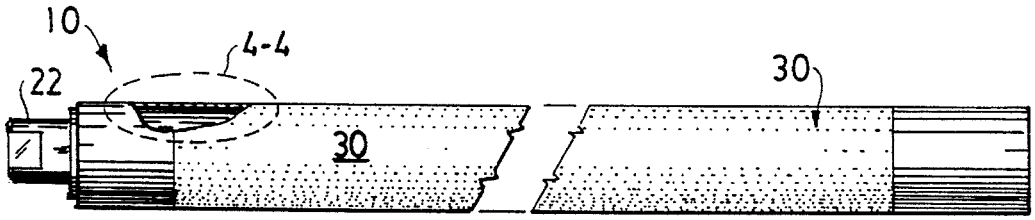
FIG. 3 is a side elevational view of the developer carrying member having a surface contour created, in the surface layer.
Figure 4:
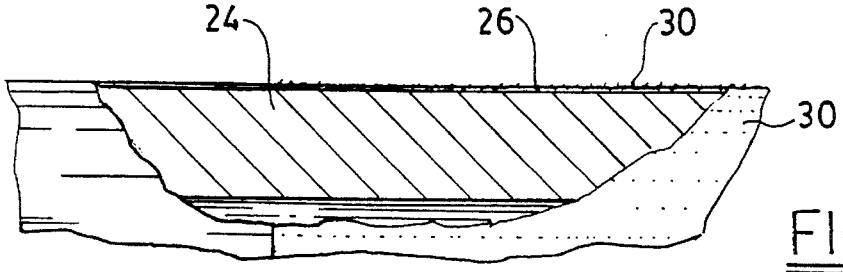
FIG. 4 is an enlarged view of a partial cross-sectional area of the developer carrying member taken along lines 4—4 of FIG. 3.

Referring to FIGS. 3 and 4, in a preferred embodiment, the sleeve 10 is a continuous piece of material having an underlying layer 24 and a surface layer 26, wherein the surface layer exhibits a greater resistance to oxidation than the underlying layer and substantially seals the underlying layer to preclude oxidation of the underlying layer. Preferably, the surface layer 26 is contiguous and integral with the underlying material of the sleeve and is formed by cold processing. That is, the sleeve 10 is a crystalline aluminum structure of photoreceptor grade aluminum with the surface layer 26 also formed of crystalline photoreceptor grade aluminum, wherein the surface layer has a modified crystalline structure to exhibit a lower oxidation rate than the underlying layer 24.

It is believed the surface layer 26 has a different grain structure than the underlying layer 24, wherein the surface layer may be characterized as an amorphous layer having sealed grain boundaries which reduces the oxidation rate of the surface layer below that of the underlying layer. The substantially sealed grain boundaries of the surface layer 26 have a greater resistance to oxidation than the unsealed grain boundaries of the underlying layer 24, and preclude exposure of the crystalline boundaries in the underlying layer to the ambient air, thereby reducing oxidation of the sleeve 10. The oxidation resistant surface layer 26 may be formed by burnishing the sleeve 10 to form the surface layer having a different grain structure than the underlying layer 24. As burnished surfaces are defined in terms of roughness, the present surface layer 26 may be defined in terms of a maximum roughness of the surface layer which provides the increased resistance to oxidation.

It is believed that to attain the amorphous sealed grain boundaries, or burnished structure of the surface layer 26 to exhibit a reduced oxidation rate, the average roughness, Ra, of the outer surface must be less than approximately 0.2 micro inches, with an Rmax of less than approximately 1.2 micro inches and an S value between approximately 2.75 and 35.5 micro inches. Ra is the arithmetical mean of the absolute values of the distances "y" from the arithmetical mean line to the roughness profile within the evaluation length "lm", and is represented by the formula:

$$Ra = \frac{1}{lm} \int_0^{lm} |f(x)| dx \approx \frac{1}{n} \sum_{i=1}^{n} |f(xi)|$$

where the roughness profile is given as f(x) with the X-axis for the centerline and the Y-axis in the direction of the vertical magnification. In practice, the value Ra is determined within the evaluation length lm which includes several sampling lengths la. According to ISO 3274, the sampling length is equal to the cutoff value [lamda c]. Rmax is the largest "single peak to valley height Zi" occurring over the evaluation length lm, where Zi is the difference between the highest peak height and the lowest valley depth of the roughness profile within the sampling length le. "S" is the mean spacing of adjacent local peaks within the evaluation length lm. The surface layer 26 has an effective thickness of approximately 1.2 micro inches.

It is believed that surface finishes having roughness values greater than these will not exhibit the modified grain structure or sealed amorphous structure in the surface layer 26 which exhibits increased resistance to oxidation. The surface finishes on the surface layer 26 are generally reflective, as such finishes have a surface roughness within the known tolerances to achieve the surface layer which provides the desired oxidation resistance. It is understood that the desired resistance to oxidation may be achieved with a surface finish that is classified as either a dull reflective or non reflective finish. That is, the finish may be reflective, dull reflective or even non reflective so long as the surface layer 26 has the modified grain structure, amorphous structure or crystalline structure that exhibits the greater resistance to oxidation than the underlying contiguous material of the sleeve.

The surface layer 26 of the sleeve 10 includes a contoured or textured finish 30 formed on at least a portion of the surface layer. The contoured finish 30 extends along approximately 8⅝ inches of the sleeve 10 and is spaced from the hub 22 by approximately 9/16 inches. The contoured finish 30 extends into the surface layer 26 but does not rapture the surface layer, so that the oxidation resistance characteristics of the surface layer and the sleeve 10 are not degraded by the formation of the contoured finish. Specifically, the contoured finish 30 has an Ra of approximately 0.45 to 0.97 micro inches, an Rmax of approximately 3.8 to 9.7 micro inches and an S value of approximately 21.5 to 48.5 micro inches. Preferably, the thickness of the surface layer 26 is greater than the Ra of the contoured finish 30 so that the underlying layer 24 remains sealed.

The specific roughness of the contoured finish 30 is determined in part by the size and characteristics of the developer (toner 6), as well as the thickness of the surface layer 26 and the desired performance characteristics of the sleeve 10. Preferably, the roughness of the contoured finish 30 is sufficient to triboelectrically charge the developer 6, without rupturing the surface layer 26 and exposing the crystalline structure of the underlying layer 24 to ambient air. The contoured finish 30 may be randomly formed in the surface layer 26 or follow a pattern. In addition, the contours may be in the form of indentations in the surface layer 26 or projections of the surface layer.

As the contoured finish 30 has a sufficient roughness to carry and charge the developer 6, without requiting additional coatings or layers, manufacturing procedures are minimized. In addition, the formation of the contoured finish 30 on the surface layer 26 without rupturing the surface layer provides the sleeve 10 with sufficient oxidation resistance to obviate the need for secondary coverings or layers. That is, the sleeve 10 is formed without secondary oxidation resistant coatings so that the operable surface of the sleeve is free of coatings.

METHOD OF MANUFACTURE

The sleeve 10 is formed from a stock of photoreceptor grade aluminum tubing. The tubing has an outer diameter approximately 0.5 mm larger than the desired diameter of the finished product. The stock tubing is cut to the desired length and one end is bored and faced to receive the transmission hub 22. The transmission hub 22 is press fit into the bored end of the robe as well known in the art.

The tube is then disposed on a lathe for cutting the outer surface of the tube. Prior to the first cut, a dampening mechanism such as a closed cell foam is inserted into the sleeve 10 to inhibit the tendency of the sleeve to oscillate at its natural frequency during the cutting process. In the preferred embodiment, two cuttings of the tube are performed.

Figure 5:
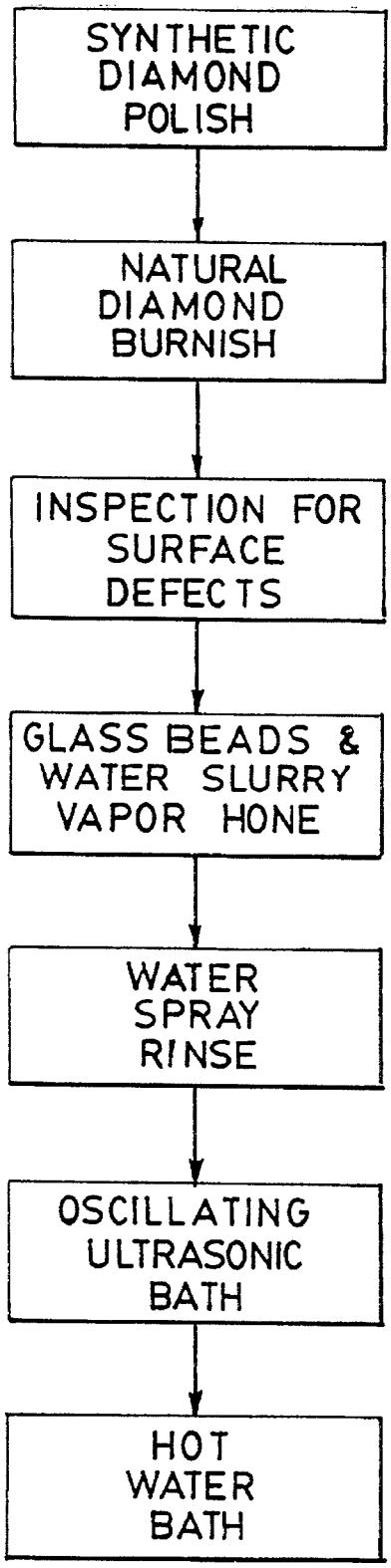
FIG. 5 is a schematic flow chart showing the formation of the developer carrying member.

Referring to FIG. 5, the first cutting is made by a synthetic diamond bit and the second cutting is made by a natural diamond bit. The first cut is made with the synthetic bit as these bits are cheaper than natural diamonds and the use of the natural diamond in the second cutting creams the desired characteristics in the surface layer 26. In the first cut, a synthetic diamond bit such as a polycrystalline diamond is used to remove approximately 0.45 mm from the diameter of the sleeve 10. The sleeve is spun at approximately 6000 rpm and the bit is moved across the sleeve 10 at a feed rate of approximately 770 mm per minute. As the highest percentage of impurities in the sleeve 10 is adjacent the outer surface of the sleeve, the amount of material removed in the first cut is sized to remove the material of highest impurities.

During the first cut, the contact area between the bit and the sleeve 10 is cooled with a kerosene based petroleum coolant or an aqueous base coolant. The coolant prevents excessive heating of the contact area which may adversely alter the crystalline structure as well as removes the cuttings to preserve the integrity of the cut.

After the first cut, a natural diamond bit is used to remove approximately 0.05 mm from the diameter of the sleeve 10 during the second cut. The turning rate and feed rate are the same as the first cut. The same coolant is applied during the second cut as in the first cut. In a preferred embodiment, the second cut with the natural diamond produces a surface layer 26 having a reflective optical finish. The surface characteristics of the surface layer are 26 defined by an average roughness Ra of less than approximately 0.2 micro inches, with an Rmax of less than approximately 1.2 micro inches and an S value between approximately 2.75 and 35.5.

It is believed such cutting with the natural diamond essentially burnishes and cold flows the substantially pure aluminum exposed during the first cutting over the surface of the sleeve 10 to form the surface layer 26 which seals the grain boundaries and overlies any remaining impurities in the sleeve material. That is, the cut with the natural diamond forms the surface layer 26 having a different crystalline structure than the underlying layer 24, wherein the structure of the surface layer exhibits an increased resistance to oxidation and covers the underlying aluminum to prevent exposure to the ambient air.

After cutting with the natural diamond, the finish of the surface layer 26 is visually inspected under a high energy halogen lamp to locate discontinuities in the surface layer such as scratches, nicks and gouges. Under the halogen lamp, the discontinuities appear as bright lines or scratches and are readily identified upon visual inspection. If discontinuities are located, the sleeve 10 is recut, as the subsequent processes do not cover or correct such discontinuities in the surface layer 26.

The contoured finish 30 is then created on at least a portion of the surface layer 26. The contoured finish 30 is sufficient to provide the necessary contours or indentations for transferring the developer 6. Preferably, the contours are sufficient to triboelectrically charge the toner 6. The contoured finish 30 is created in the surface layer 26 without penetrating the surface layer. That is, as shown in FIG. 4, at least a portion of the thickness of the surface layer 26 remains intact beneath the contoured finish 30 so as to provide oxidation resistance for the underlying layer 24.

In a preferred embodiment, the contoured finish 30 is created by vapor honing. The vapor honing impinges a slurry against the diamond cut surface layer 26 of the sleeve 10. The slurry composition and impact parameters are controlled so that the impacting slurry does not penetrate the surface layer 26. It is understood that the term vapor honing is a generic term for impacting a slurry against an object. Although vapor honing is employed, the present invention is not limited to wet slurry processes but may include dry blasting processes as known in the art.

Although the vapor honing may be employed to create any of a variety of finish contours in the surface layer 26, the preferred slurry is formed of a 30 micron glass bead media in a water carrier. The media is manufactured by BLAST TIE under the name BOL-30. Prior to use in the slurry, the media is classified by a vibrating screen to a 30 micron diameter ±2 microns. The nearer to particles are to the 30 micron size average, the better the results. Approximately ten pounds of the classified media is mixed with approximately 10 gallons of de-ionized 1 meg ohm water to form the slurry. A slurry pump and enclosure, as known in the art, are employed to circulate the slurry and house the sleeve 10 during the vapor honing process. The slurry is sufficiently agitated to keep the media in suspension and provide a homogeneous slurry. The slurry is then impacted against the sleeve 10 through a No. 5 ceramic nozzle at approximately 50 psi at a distance of approximately 4.5 inches from the surface of the sleeve. The sleeve 10 is rotated at approximately 80 revolutions per minute relative to the nozzle and the nozzle is moved at a feed rate of approximately 18 inches per minute transverse speed to the sleeve 10. Under these parameters, a single pass of the nozzle relative to the sleeve 10 is required to form the necessary contours.

The distance between the nozzle and the sleeve 10, the hardness of the media, concentration of the slurry, nozzle configuration, slurry pressure, spin and feed rate and media configuration are interdependent factors. These factors are controlled so that the impacting slurry will not rupture the surface layer 26 and expose the underlying material to the ambient air. That is, the integrity of the surface layer 26 remains in tact.

Although not required in line processing, in batch processing the vapor honed sleeves are disposed in an ambient temperature bath of de-ionized 1 meg ohm water, to prevent solidification of the slurry on the surface of the sleeve.

The sleeves 10 are then rinsed in ambient temperature de-ionized 1 meg ohm water under a high pressure spray rinse for approximately 30 seconds to clean the slurry from the sleeve.

The sleeves 10 are then disposed in a subsequent ambient temperature bath of de-ionized 1 meg ohm water and exposed to ultra sonic waves at approximately 25 khz for approximately 1 minute. The location of the ultra sonic wave source is varied throughout the bath and the positions of the cylinders is also varied to avoid burning the sleeves. A wave generator manufactured by Ney has been found satisfactory.

The cleaned sleeves 10 are then disposed in a rinse of de-ionized 1 meg ohm water at approximately 160° F. The sleeves are retained in the water until the sleeves are substantially the temperature of the water. The sleeves are slowly withdrawn from the water so that the water sheets from the sleeves and the elevated temperature of the sleeve accelerates evaporation of any residual water.

Although the present construction of the sleeve is sufficient for most applications in image developing devices, applications in high volume systems may require a hardening coating to be placed on the finished surface. The hard coating has a 5 micron thickness and is hard coat anodized or 2 microns of (yellow or clear) chromatic.

As the surface layer 26 and the remainder of the sleeve 10 are formed of a contiguous, integral piece of material, the operable sleeve may be formed free of secondary (nonsleeve material) coatings.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A developer carrying device for transferring a powdery developer in a developing apparatus from a supply of the powdery developer to a latent image bearing member, comprising:

(a) a developer carrying member for carrying the developer from the supply to a developing zone where the latent image bearing member passes;

wherein the developer carrying member has a surface cut with a diamond to form a surface layer having surface finish defined by an Ra less than approximately 0.2 micro inches, an Rmax of less than approximately 1.2 micro inches and an S value of less than approximately 35.5 micro inches; and wherein the surface layer is impacted with substantially spherical particles having a diameter of approximately 30 microns to form a contoured surface having an Ra of approximately 0.45 to 0.97 micro inches, an Rmax of approximately 3.8 to 4.7 micro inches and an S value of approximately 21.5 to 48.5 micro inches for transferring the developer from the supply to the developing zone.

2. The developer carrying device of claim 1, further comprising a hardening coating on the surface layer.

3. A developer transfer roller, comprising:

(a) a developer transfer sleeve of electrically conductive polycrystalline material having a first grain structure; and (b) a surface layer on the developer transfer sleeve, the surface layer comprising the polycrystalline material having a second grain structure and a surface contour.

4. The transfer roller of claim 3, wherein the surface layer has a roughness defined by an Ra less than approximately 0.2 micro inches, an Rmax less than approximately 1.2 micro inches and an S value less than approximately 35.5 micro inches.

5. The transfer roller of claim 3, wherein the surface contour defines a roughness of Ra of approximately 0.45 to 0.97 micro inches, an Rmax of approximately 3.8 to 4.7 micro inches and an S value of approximately 21.5 to 48.5 micro inches.

6. The transfer roller of claim 3, wherein the polycrystalline material is photoreceptor grade aluminum.

7. The transfer roller of claim 3, wherein the second grain structure has a lower oxidation rate than the first grain structure.

8. The transfer roller of claim 3, wherein the second grain structure is substantially amorphous.

9. The transfer roller of claim 3, further comprising a hardening coating on the surface layer.

10. A developer carrying member for transferring a developer material from a source to a developing zone, comprising:

(a) an electrically conductive member having an outer surface selectively exposable to the source and the developing zone, the outer surface defined by substantially sealed intermetallic grain boundaries and a textured portion defined by surface contours having a sufficient dimension to triboelectrically charge the developer material.

11. The developer carrying member of claim 10, further comprising a hardening coating on the outer surface.

12. A developer carrying member for transferring a developer material from a source to a developing zone, comprising:

(a) an electrically conductive developer carrying member; and (b) a surface layer on the conductive developer carrying member having a first average surface roughness With an increased resistance to oxidation and a contoured finish having a greater second average surface roughness sufficient to transfer the developer material from the source to the developing zone.

13. The developer carrying member of claim 12, further comprising a hardening coating on the surface layer.

14. A developer carrying member for transferring a developer material from a source to a developing zone, comprising:

(a) an electrically conductive member selectively exposable to the source and the developing zone, the conductive member formed of a first material;

(b) a surface layer on the conductive member formed of the first material and having an increased resistance to oxidation; and (c) a contoured finish in the surface layer sufficient to transfer the developer material from the source to the developing zone.

15. The developer carrying member of claim 14, further comprising a hardening coating on the surface layer.

16. A method of preparing the surface of an aluminum magnetic roller sleeve for transferring a developer material from a source to a developing zone adjacent a electrographic photosensitive member, comprising:

(a) burnishing the surface of the sleeve with a diamond to form a surface layer having a reduced oxidation rate; and (b) impacting a slurry of particles onto the surface layer to form a plurality of indentations substantially within the surface layer.

17. The method of claim 16, wherein the particles have a predetermined size of approximately 30 micro inches.

18. The method of claim 16, wherein the slurry includes glass particles in an aqueous carrier.

19. The method of claim 16, wherein the diamond is a natural diamond.

20. A method of preparing the surface of an aluminum magnetic roller sleeve for transferring a developer material from a source to a developing zone, comprising:

(a) burnishing the surface of the sleeve with a diamond to cold flow the surface material and seal the intermetallic grain boundaries and define a first surface roughness; and (b) impacting a slurry of particles on the burnished surface with sufficient force to create a surface contour having an average roughness greater than the first surface roughness.

21. A method for preparing the surface of a sleeve of a polycrystalline material having a first crystalline structure; comprising:

(a) forming a surface layer of the polycrystalline material having a second crystalline structure; and (b) impacting a plurality of particles on the surface layer to form indentations substantially within the surface layer.

22. A method of preparing a surface of a developer transfer roller, comprising:

(a) cutting the developer transfer roller with a diamond to form a surface layer having a lower oxidation rate than the remaining sleeve; and (b) wet honing the surface of the developer transfer roller with a slurry of particles to create a surface contour in the surface layer.

23. The method of claim 22, further comprising wet honing to create a surface contour having a sufficient roughness to triboelectrically charge the developer material.

24. The method of claim 22, further comprising applying an abrasion resistant coating on the surface layer.

25. A method of preparing a surface of a developer carrying member for transferring a developer material from a source to a developing zone, comprising:

(a) cutting the surface of the developer carrying member with a diamond to create a first average surface roughness and impart a resistance to oxidation; and (b) impacting a flowable medium against the diamond cut surface to create a second average roughness greater than the first average surface roughness.

26. A developer carrying member for transferring a developer material from a source to a developing zone, comprising:

(a) an electrically conductive member for exposure to the source and the developing zone, the conductive member formed of a first material;

(b) a surface layer on the conductive member formed of the first material and having an increased resistance to oxidation; and (c) a contoured finish in the surface layer sufficient to transfer the developer material from the source to the developing zone.

27. The developer carrying member of claim 26, wherein the surface layer has substantially sealed grain boundaries.

28. The developer carrying member of claim 26, further comprising a hardening coating on the surface layer.

29. A method for preparing the surface of a developer carrying sleeve for transferring a developer material from a source to a developing zone, the sleeve formed of a polycrystalline material having a first crystalline structure; comprising:

(a) forming a surface layer of the polycrystalline material having a second crystalline structure; and (b) impacting a plurality of particles on the surface layer to form indentations in the surface layer sufficient to transfer the developer material from the source to the developing zone.

30. The method of claim 29, wherein forming the surface layer includes contacting the polycrystalline material with a diamond.

31. The method of claim 29, wherein forming the surface layer includes increasing the resistance to oxidation.

* * * * *